US006527527B2

(12) United States Patent
Fujita et al.

(10) Patent No.: US 6,527,527 B2
(45) Date of Patent: Mar. 4, 2003

(54) SCROLL COMPRESSOR

(75) Inventors: Katsuhiro Fujita, Nishi-kasugai-gun (JP); Makoto Takeuchi, Nagoya (JP); Takahide Itoh, Nagoya (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/040,622

(22) Filed: Jan. 9, 2002

(65) Prior Publication Data

US 2002/0094290 A1 Jul. 18, 2002

(30) Foreign Application Priority Data

Jan. 18, 2001 (JP) ..... 2001-010391

(51) Int. Cl.[7] ..... F03C 2/00
(52) U.S. Cl. ..... 418/55.2
(58) Field of Search ..... 418/55.2

(56) References Cited

U.S. PATENT DOCUMENTS 4,477,238 A * 10/1984 Terauchi ..... 418/55.2

FOREIGN PATENT DOCUMENTS

| | | |
|---|---|---|
| JP | 60-17956 | 5/1985 |
| JP | 4-311693 | 11/1992 |
| JP | 8-28461 | 1/1996 |
| JP | 9-112456 | 5/1997 |

OTHER PUBLICATIONS

U.S. patent application Ser. No. 09/985,493, filed Nov. 5, 2001, pending.
U.S. patent application Ser. No. 10/040,630, filed Jan. 9, 2002, pending.
U.S. patent application Ser. No. 10/049,911, filed Feb. 20, 2002, pending.
U.S. patent application Ser. No. 10/049,903, filed Feb. 20, 2002, pending.
U.S. patent application Ser. No. 10/158,058, filed May 31, 2002, pending.

* cited by examiner

*Primary Examiner*—Thomas Denion
*Assistant Examiner*—Theresa Trieu
(74) *Attorney, Agent, or Firm*—Oblon, Spivak, McClelland, Maier & Neustadt, P.C.

(57) ABSTRACT

A scroll compressor comprises a fixed scroll which is fixed in position and has a spiral wall body provided on one side surface of an end plate, and an orbiting scroll which has a spiral wall body provided on one side surface of an end plate, being supported by engaging of the wall bodies so as to orbit and revolve around the fixed scroll without rotation. When a length of the wall body which is further out than a first step portion which is provided on the end plate, is represented by H and a step difference of the first step portion is represented by L, L/H is 0.2 or less.

1 Claim, 8 Drawing Sheets

PRIOR ART

PRIOR ART

SCROLL COMPRESSOR

BACKGROUND OF THE INVENTION

1. Field of the Invention

The present invention relates to a scroll compressor which is installed in an air conditioner, a refrigerator, or the like.

2. Description of Related Art

In conventional scroll compressors, a fixed scroll and an orbiting scroll are provided by engaging their spiral wall bodies, and fluid inside a compression chamber, formed between the wall bodies, is compressed by gradually reducing the capacity of the compression chamber as the orbiting scroll revolves around the fixed scroll.

The compression ratio in the design of the scroll compressor is the ratio of the maximum capacity of the compression chamber (the capacity at the point when the compression chamber is formed by the meshing of the wall bodies) to the minimum capacity of the compression chamber (the capacity immediately before the wall bodies become unmeshed and the compression chamber disappears), and is expressed by the following equation (I).

$$Vi=\{A(\theta_{suc})\cdot L\}/\{A(\theta_{top})\cdot L\}=A(\theta_{suc})/A(\theta_{top}) \quad \text{(I)}$$

In equation (I), $A(\theta)$ is a function expressing the cross-sectional area parallel to the rotation face of the compression chamber which alters the capacity in accordance with the rotating angle $\theta$ of the orbiting scroll; $\theta_{suc}$ is the rotating angle of the orbiting scroll when the compression chamber reaches its maximum capacity, $\theta_{top}$ is the rotating angle of the orbiting scroll when the compression chamber reaches its minimum capacity, and L is the lap (overlap) length of the wall bodies.

Conventionally, in order to increase the compression ratio Vi of the scroll compressor, the number of windings of the wall bodies of the both scrolls is increased to increase the cross-sectional area $A(\theta)$ of the compression chamber at maximum capacity. However, in the conventional method of increasing the number of windings of the wall bodies, the external shape of the scrolls is enlarged, increasing the size of the compressor; for this reason, it is difficult to use this method in an air conditioner for vehicles and the like which have strict size limitations.

In an attempt to solve the above problems, Japanese Examined Patent Application, Second Publication, No. Sho 60-17956 (Japanese Unexamined Patent Application, First Publication, No. Sho 58-30494) proposes the following techniques.

FIG. 9A shows a fixed scroll 50 of the above application comprising an end plate 50*a* and a spiral wall body 50*b* provided on a side surface of the end plate 50*a*. FIG. 9B shows an orbiting scroll 51 similarly comprising an end plate 51*a* and a spiral wall body 51*b* provided on a side surface of the end plate 51*a*.

A step portion 52 is provided on the side surface of the end plate 50*a* of the fixed scroll 50. The step portion 52 has two parts in which one part is high at the center of the side surface of the end plate 50*a* and the other part is low at the outer end of the end plate 50*a*. Furthermore, corresponding to the step portion 52 of the end plate 50*a*, a step portion 53 is provided on a spiral top edge of the wall body 50*b* of the fixed scroll 50. The step portion 53 has two parts in which one part is high at the center of the spiral top edge and the other part is low at the outer end of the spiral top edge. Similarly, a step portion 52 is provided on the side surface of the end plate 51*a* of the orbiting scroll 51. The step portion 52 has two parts in which one part is high at the center of the side surface of the end plate 51*a* and the other part is low at the outer end of the end plate 51*a*. Furthermore, corresponding to the end plate 51*a* of the step portion 52, a step portion 53 is provided on a spiral top edge of the wall body 51*b* of the orbiting scroll 51. The step portion 53 has two parts in which one part is high at the center of the spiral top edge and the other part is low at the outer end of the spiral top edge.

FIG. 10A is a plan view of the orbiting scroll and FIG. 10B is a cross-sectional view taken along line I—I of FIG. 10A. The perpendicular length (lap length) of the wall body which is further out than the step portion 52 is represented by H. The step difference of the step portion 52 is represented by L. The perpendicular length (lap length) of the wall body which is further in than the step portion 52 is represented by H2.

As shown in FIG. 10B, the lap length H of the wall body which is further out than the step portion 52 is longer than the lap length H2 of the wall body which is further in than the step portion 52. The maximum capacity of the compression chamber P increases as the lap length of the wall body which is further out than the step portion 52 becomes larger, in comparison with the maximum capacity of the compression chamber having the uniform lap length. Consequently, the compression ratio Vi in the design can be increased without increasing the number of spiral laps of the wall body. Furthermore, since the lap length of each step is short, concentration of stress can be avoided.

However, when the compression ratio Vi is increased as described above, the following problems are generated. As shown in FIG. 11, as the compression ratio Vi is increased, the pressure rapidly increases according to the rotating angle. Furthermore, a gap tends to remain at the engaging parts between the step portions 52 and 53 due to machining tolerance or the like. If the length L is great, the amount of leakage of refrigerant from the compression chamber is increased.

In other words, when L/H is increased in order to increase the compression ratio Vi, theoretical efficiency is increased; however, in fact, the amount of leakage of refrigerant via the engaging part between the step portions 52 and 53 from the compression chamber is increased because of high pressure and increase of the height L. Therefore, there is a problem that the compression efficiency of the scroll compressor decreases due to leakage.

BRIEF SUMMARY OF THE INVENTION

In view of the above problems, an object of the present invention is to provide a scroll compressor in which the compression efficiency is increased.

An aspect according to the present invention is to provide a scroll compressor comprising a fixed scroll which is fixed in position and has a spiral wall body provided on one side surface of an end plate; an orbiting scroll which has a spiral wall body provided on one side surface of an end plate, being supported by engaging of the wall bodies so as to orbit and revolve around the fixed scroll without rotation; a first step portion provided on the end plate of one of the fixed scroll and the orbiting scroll, being at a high level at a center side and at a low level at an outer end side along the spiral wall body on one side surface of the end plate; and a second step portion provided on a top edge of the wall body of the other of the fixed scroll and the orbiting scroll by dividing the top edge into plural parts, the second step portion being at a high level to at a low level from the outer end to the center in correspondence with the first step portion, wherein, when a length of the wall body is represented by H at the outer side from the first step portion and a step difference of the first step portion is represented by L in the one scroll, L/H is 0.2 or less.

As described above, since the amount of leakage is increased as L/H is increased, a compression efficiency decreases. FIG. 12 is a graph showing a relationship between L/H and compression efficiency. As shown in FIG. 12, if L/H is 0.2 or less, a superior scroll compressor is obtained by preventing decrease of the compression efficiency and avoiding concentration of stress. Furthermore, the scroll compressor has satisfactory compression efficiency by avoiding leakage of refrigerant.

DETAILED DESCRIPTION OF THE INVENTION

An embodiment of the scroll compressor according to the present invention will be explained with reference to FIGS. 1 to 8.

Figure 1:
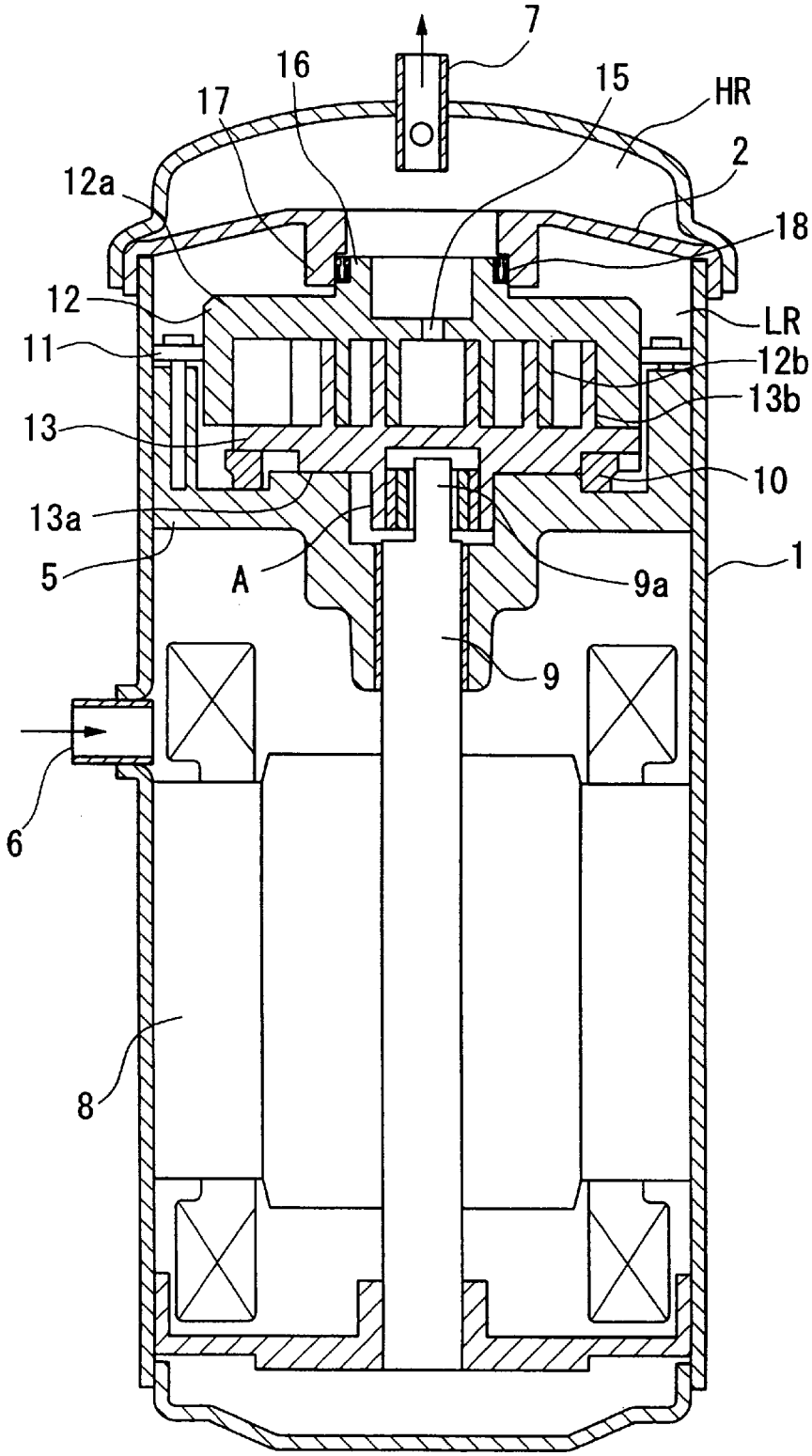
FIG. 1 is a side cross-sectional view of an embodiment of the scroll compressor according to the present invention.

FIG. 1 shows a configuration of a back pressure scroll compressor as an embodiment of the present invention. The scroll compressor comprises an airtight housing 1, a discharging cover 2 which separates the housing 1 into a high pressure chamber (HR) and a low pressure chamber (LR), a frame 5, a suction pipe 6, a discharge pipe 7, a motor 8, a rotating shaft 9, and a mechanism preventing rotation 10.

Figure 2:
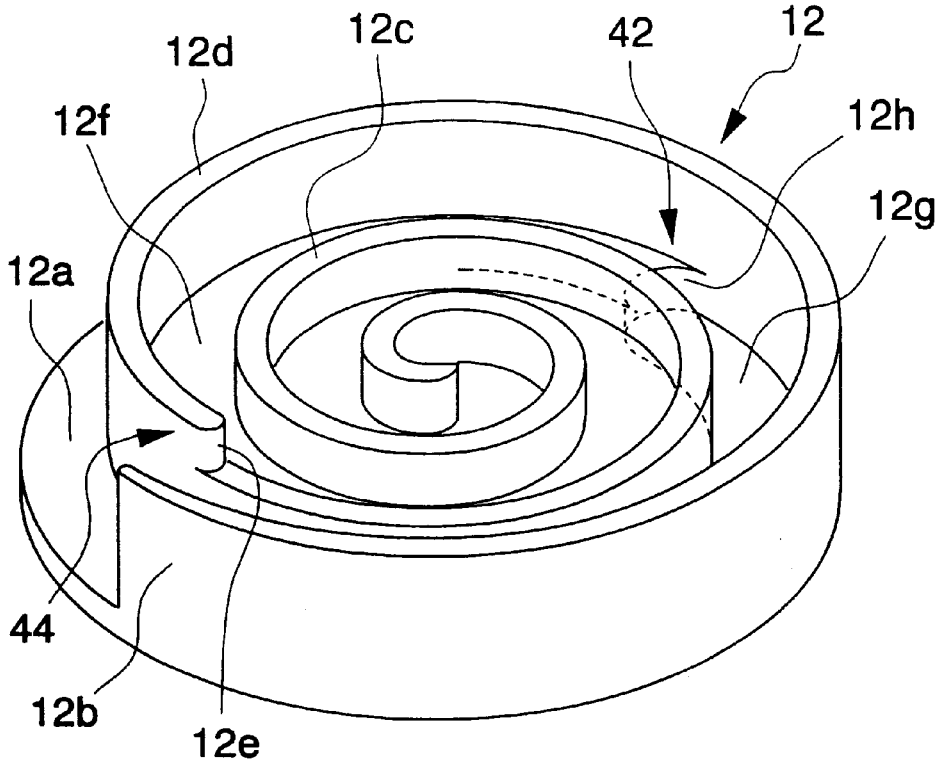
FIG. 2 is a perspective view of a fixed scroll provided in the scroll compressor according to the present invention.

Furthermore, the scroll compressor has a fixed scroll 12 and an orbiting scroll 13 which is engaged with the fixed scroll 12. As shown in FIG. 2, the fixed scroll 12 comprises a spiral wall body 12*b* provided on a side surface of an end plate 12*a*. The orbiting scroll 13 similarly comprises a spiral wall body 13*b* provided on a side surface of an end plate 13*a*, in particular, the wall body 13*b* being identical in shape to the wall body 12*b* of the fixed scroll 12. The orbiting scroll 13 is eccentrically provided against the fixed scroll 12 by the revolution radius and is engaged to the fixed scroll 12 with a phase shift of 180 degrees by engaging the wall bodies 12*b* and 13*b*.

In such a back pressure scroll compressor, the fixed scroll 12 is not completely secured to the frame 5 with a bolt or the like, and therefore, the fixed scroll 12 is movable within a predetermined area.

A cylindrical boss A is provided at the other side face of the end plate 13*a* of the orbiting scroll 13 (while the wall body 13*b* is provided on one side face of the end plate 13*a*). The eccentric section 9*a* which is provided at the upper end of the rotating shaft 9 driven by the motor 4, is accommodated in the boss A so as to freely rotate therein. Thereby, the orbiting scroll 13 orbits around the fixed scroll 12 and its rotation is prevented by the mechanism preventing rotation 10.

On the other hand, the fixed scroll 12 is supported to the frame 5 via a compressed spring (an elastic body) so as to freely move and is pressed to the orbiting scroll 13. In the center of the back of the end plate 12*a*, a discharge port 15 for discharging compressed fluid is provided. On the periphery of the discharge port 15, a cylindrical flange 16 which is projected from the back surface of the end plate 12*a* of the fixed scroll 12 is provided and is engaged with a cylindrical flange 17 provided at the discharge cover 2. The engaging part of the cylindrical flanges 16 and 17 has a sealing structure by a sealing member 18, so that the chamber is separated into the high pressure chamber (HR) and the low pressure chamber (LR) and the fixed scroll 12 needs to be pressed downward by supplying high pressure (back pressure) to the back surface of the fixed scroll. The sealing member 18 has a U-shape in cross-sectional view; the high pressure chamber (HR) further acts as a back pressure room for supplying high discharging pressure at the back surface of the fixed scroll 12.

As shown in FIG. 2, the end plate 12*a* of the fixed scroll 12 comprises a step portion 42 provided on one side surface on which the wall body 12*b* is provided so that the step portion 42 has two parts in which one part is high at the center side of the top edge of the spiral wall body 12*b* and the other part is low at the outer end side of the top edge of the spiral wall body 12*b*.

Figure 3:
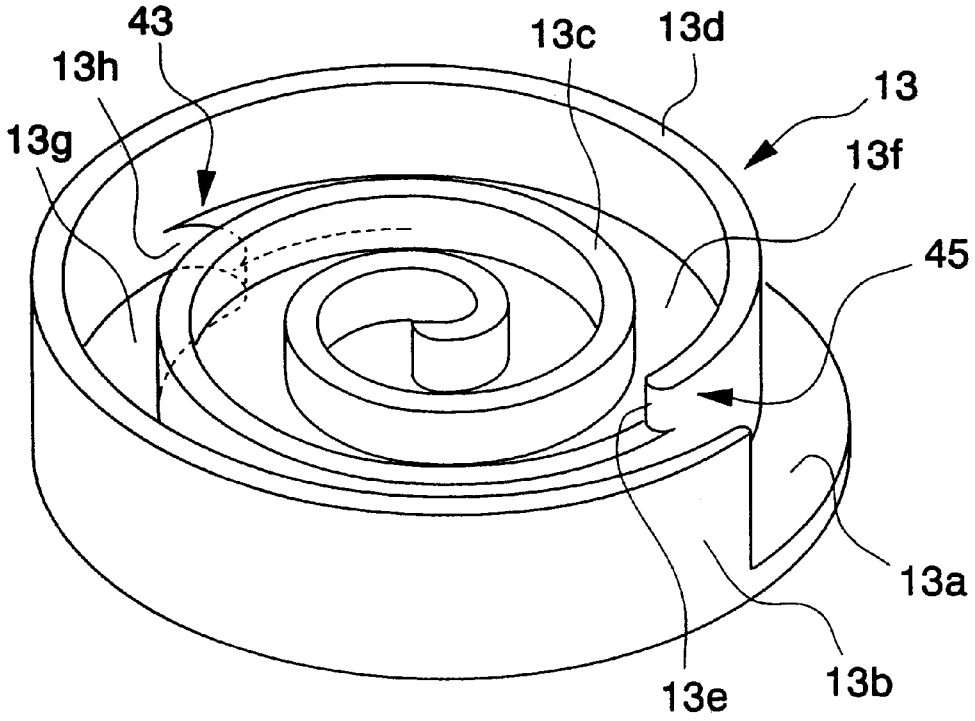
FIG. 3 is a perspective view of an orbiting scroll provided in the scroll compressor according to the present invention.

As shown in FIG. 3, the end plate 13*a* of the orbiting scroll 13 similarly comprises a step portion 43 provided on one side surface on which the wall body 13*b* is provided so that the step portion 43 has two parts in which one part is high at the center side of the top edge of the spiral wall body 13*b* and the other part is low at the outer end side of the top edge of the spiral wall body 13*b*.

The bottom surface of the end plate 12*a* is divided into two parts of a bottom surface 12*f* having short length between the top edge of the wall body and the bottom surface 12*f*, and the bottom surface 12*g* having long length between the top edge of the wall body and the bottom surface 12*g*. The bottom surface 12*f* is provided at the center side of the spiral wall body 12*b*, and the bottom surface 12*g* is provided at the outer end side of the spiral wall body 12*b*. The step portion 42 is provided between the adjacent bottom surfaces 12*f* and 12*g* and a connecting wall surface 12*h* which connects the bottom surfaces 12*f* and 12*g* is provided so as to be perpendicular to the bottom surfaces 12*f* and 12*g*. The bottom surface of the end plate 13*a* is similarly divided into two parts of a bottom surface 13*f* having short length between the top edge of the wall body and the bottom surface 13*f*, and the bottom surface 13*g* having long length between the top edge of the wall body and the bottom surface 13*g*. The bottom surface 13*f* is provided at the center side of the spiral wall body 13*b* and the bottom surface 13*g* is provided at the outer end side of the spiral wall body 13*b*. The step portion 43 is provided between the adjacent bottom surfaces 13*f* and 13*g* and a connecting wall face 13*h* which connects the bottom surfaces 13*f* and 13*g* is provided so as to be perpendicular to the bottom surfaces 13*f* and 13*g*.

Figure 4A:
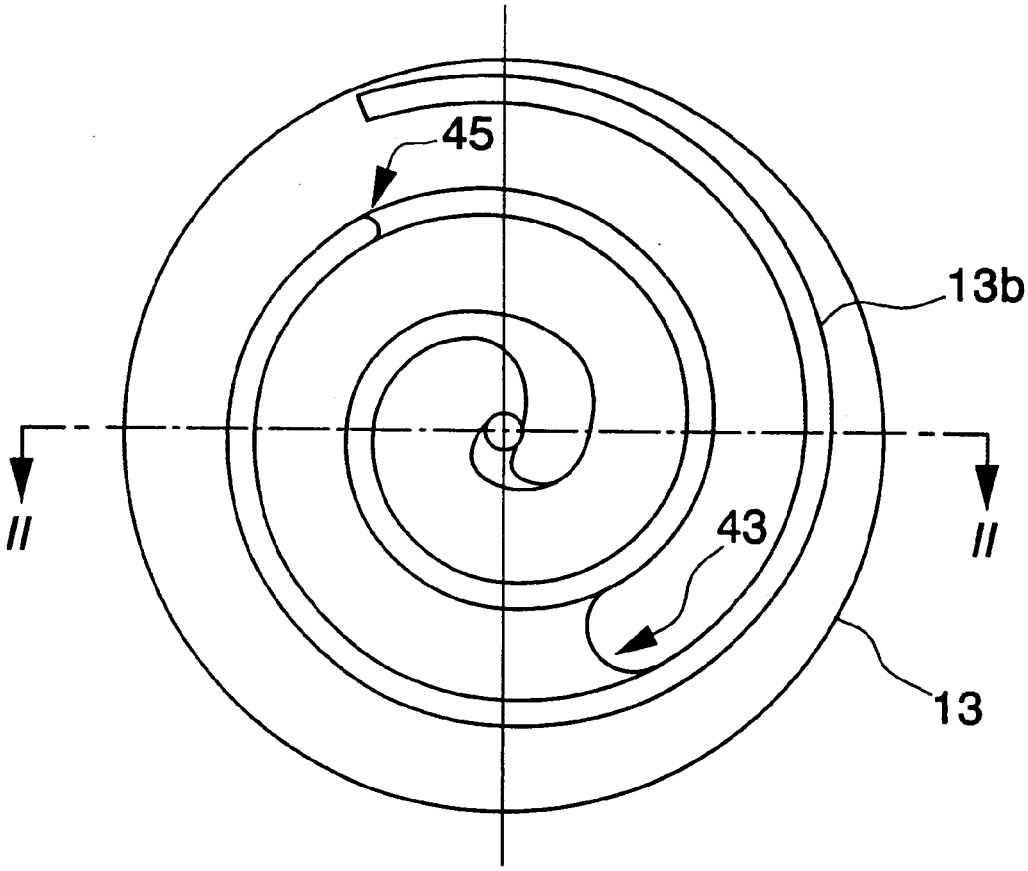
FIG. 4A is a plan view of an orbiting scroll provided in the scroll compressor according to the present invention.
Figure 4B:
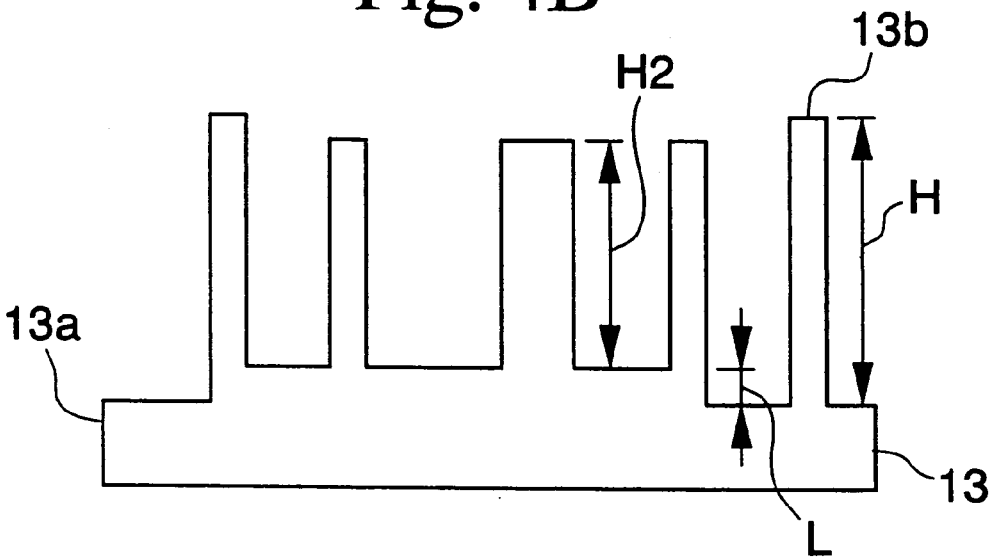
FIG. 4B is a side cross-sectional view of an orbiting scroll provided in the scroll compressor according to the present invention.

FIG. 4A is a plan view of the orbiting scroll 13 and FIG. 4B is a cross-sectional view taken along line II—II of FIG. 4A. The orbiting scroll 13 will be explained as follows. The fixed scroll 12 has components which are similar to those of the orbiting scroll 13.

As shown in FIGS. 4A and 4B, in the orbiting scroll 13, the perpendicular length of the spiral wall body 13*b* which is further out than the step portion 43 is represented by H, the perpendicular length of the spiral wall body 13*b* which is further in than the step portion 43 is represented by H2. Furthermore, the step difference of the step portion 43, that is to say, the perpendicular length of the connecting wall face 13*h* is represented by L.

H and L are predetermined within the following range.

Figure 12:
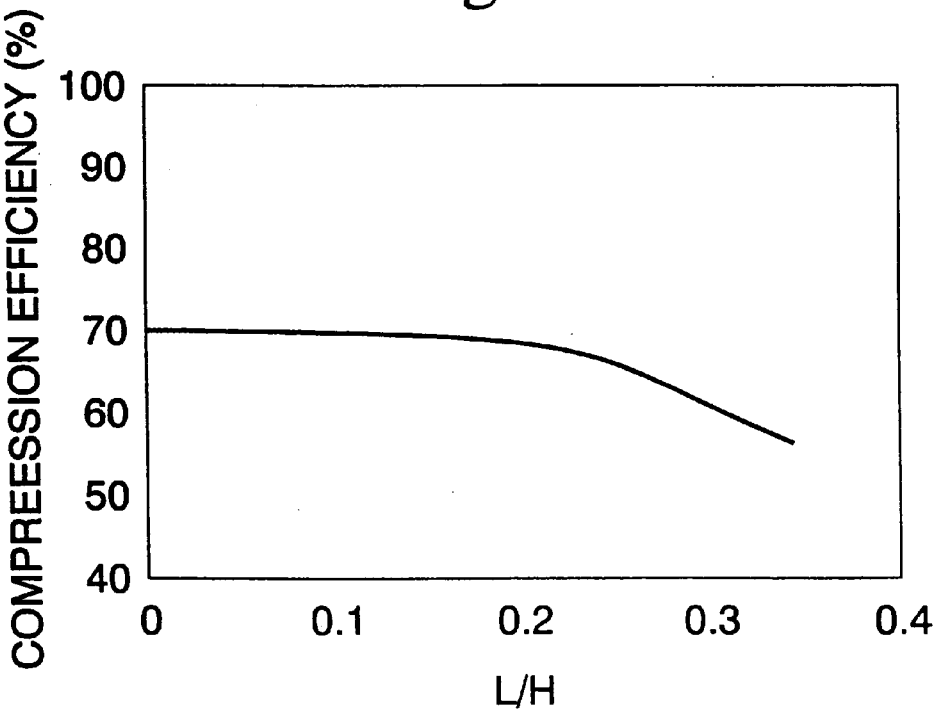
FIG. 12 is a graph showing the relationship between L/H and compression efficiency.

FIG. 12 a graph obtained by analyzing a relationship between L/H and a compression efficiency. As shown in FIG. 12, if L/H is too large, the amount of leakage of refrigerant through the step portion 43 increases and then, compression efficiency decreases. To avoid decreasing compression efficiency, H and L in the present invention is predetermined so that $L/H \leqq 0.2$.

The spiral top edge of the wall body 12*b* of the fixed scroll 12 is divided into two parts corresponding to the step portion 43 of the orbiting scroll 13 and is low at the center side and high at the outer side. The spiral top edge of the wall body 13*b* of the orbiting scroll is similarly divided into two parts corresponding to the step portion 42 of the fixed scroll 12 and is low at the center side and high at the outer side.

For example, the top edge of the wall body 12*b* is divided into two portions of the lower top edge 12*c* provided at the center side of the spiral wall body 12*b* and the higher top edge 12*d* provided at the outer side of the spiral wall body 12*b*. A connecting edge 12*e* which connects the adjacent top edges 12*c* and 12*d* is provided therebetween so as to be perpendicular to the rotating surface. Furthermore, the top edge of the wall body 13*b* is similarly divided into two portions of the lower top edge 13*c* provided at the center side of the spiral wall body 13*b* and the higher top edge 13*d* provided at the outer side of the spiral wall body 13*b*. A connecting edge 13*e* which connects the adjacent top edges 13*c* and 13*d* is provided therebetween so as to be perpendicular to the rotating surface.

When the wall body 12*b* is seen from the direction of the orbiting scroll 13, the connecting edge 12*e* is smoothly connected to the inner and outer side surfaces of the wall body 12*b*, and is a semicircle having a diameter equal to the thickness of the wall body 12*b*. Similarly, when the wall body 13*b* is seen from the direction of the fixed scroll 12, the connecting edge 13*e* is smoothly connected to the inner and outer side surfaces of the wall body 13*b*, and is a semicircle having a diameter equal to the thickness of the wall body 13*b*.

When the end plate 12*a* is seen from the rotation axis direction, the shape of the connecting wall surface 12*h* is a circular arc which matches the envelope curve drawn by the connecting edge 13*e* as the orbiting scroll 13 orbits. Similarly, the shape of the connecting wall surface 13*h* is a circular arc which matches the envelope curve drawn by the connecting edge 12*e*.

A tip seal is not provided on the top edges of the wall body 12*b* of the fixed scroll 12 and the wall body 13*b* of the orbiting scroll 13. The airtightness of a compression chamber C (explained later) is maintained by compressing the end surfaces of the wall bodies 12*b* and 13*b* with the end plates 12*a* and 13*a*.

When the orbiting scroll 13 is attached to the fixed scroll 12, the lower top edge 13*c* directly contacts the shallow bottom surface 12*f*, and the higher top edge 13*d* directly contacts the deep bottom surface 12*g*. Simultaneously, the lower top edge 12*c* directly contacts the shallow bottom face 13*f*, and the higher top edge 12*d* directly contacts the deep bottom face 13*g*. Consequently, a compression chamber C is formed by partitioning the space in the compressor by the end plates 12*a* and 13*a*, and the wall bodies 12*b* and 13*b*, which face each other between the two scrolls.

The compression chamber C moves from the outer end toward the center as the orbiting scroll 13 rotates. While the contact points of the wall bodies 12*b* and 13*b* are nearer the outer end than the connecting edge 12*e*, the connecting edge 12*e* slides against the connecting wall surface 13*h* so that there is no leakage of fluid between the compression chambers C (one of which is not airtight), which are adjacent to each other with the wall body 12 therebetween. While the contact points of the wall bodies 12*b* and 13*b* are not nearer the outer end than the connecting edge 12*e*, the connecting edge 12*e* does not slide against the connecting wall surface 13*h* so that equal pressure is maintained in the compression chambers C (both of which are airtight), which are adjacent to each other with the wall body 12 therebetween.

Similarly, while the contact points of the wall bodies 12*b* and 13*b* are nearer the outer end than the connecting edge 13*e*, the connecting edge 13*e* slides against the connecting wall surface 12*h* so that there is no leakage of fluid between the compression chambers C (one of which is not airtight), which are adjacent with the wall body 13 therebetween. While the contact points of the wall bodies 12*b* and 13*b* are not nearer the outer end than the connecting edge 13*e*, the connecting edge 13*e* does not slide against the connecting wall surface 12*h* so that equal pressure is maintained in the compression chambers C (both of which are airtight), which are adjacent with the wall body 13 therebetween. Additionally, the connecting edge 12*e* slides against the connecting wall surface 13*h* at the same time as the connecting edge 13*e* slides against the connecting wall surface 12*h* during a half-orbit of the orbiting scroll 13.

The process of compressing fluid during operation of the scroll compressor having the constitution described above will be explained with reference to FIGS. 5 to 8 in that order.

Figure 5:
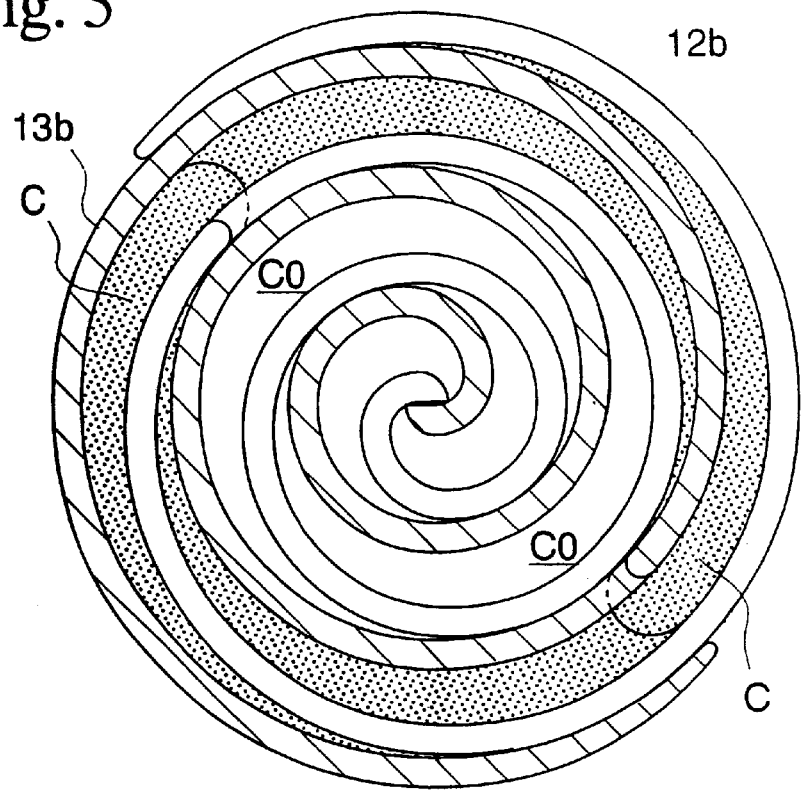
FIG. 5 is a diagram illustrating a process of compressing a fluid when driving the scroll compressor.

In the state shown in FIG. 5, the outer end of the wall body 12*b* directly contacts the outer side surface of the wall body 13*b*, and the outer end of the wall body 13*b* directly contacts the outer side surface of the wall body 12*b*; the fluid is injected between the end plates 12*a* and 13*a*, and the wall bodies 12*b* and 13*b*, forming two large-capacity compression chambers C at exactly opposite positions on either side of the center of the scroll compressor mechanism. At this time, the connecting edge 12*e* slides against the connecting wall surface 13*h*, and the connecting edge 13*e* slides against the connecting wall surface 12*h*, but this sliding ends immediately afterwards.

Figure 6:
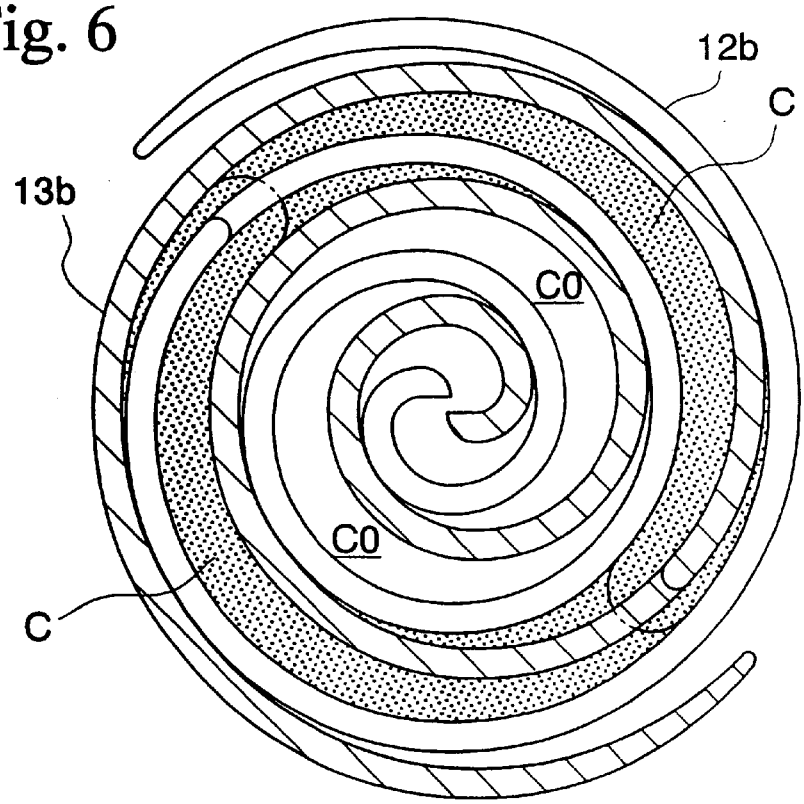
FIG. 6 is another diagram illustrating a process of compressing a fluid when driving the scroll compressor.

FIG. 6 shows the state when the orbiting scroll 13 has orbited by π/2 from the state shown in FIG. 5. In this process, the compression chamber C moves toward the center with its airtightness intact while compressing the fluid by the gradual reduction of its capacity; the compression chamber C0 preceding the compression chamber C also moves toward the center with its airtightness intact while continuing to compress the fluid by the gradual reduction of its capacity. The sliding contact between the connecting edge 12*e* and the connecting wall surface 13*h*, and between the connecting edge 13*e* and the connecting wall surface 12*h*, ends in this process, and the two compression chambers C, which are adjacent to each other, are joined together with equal pressure.

Figure 7:
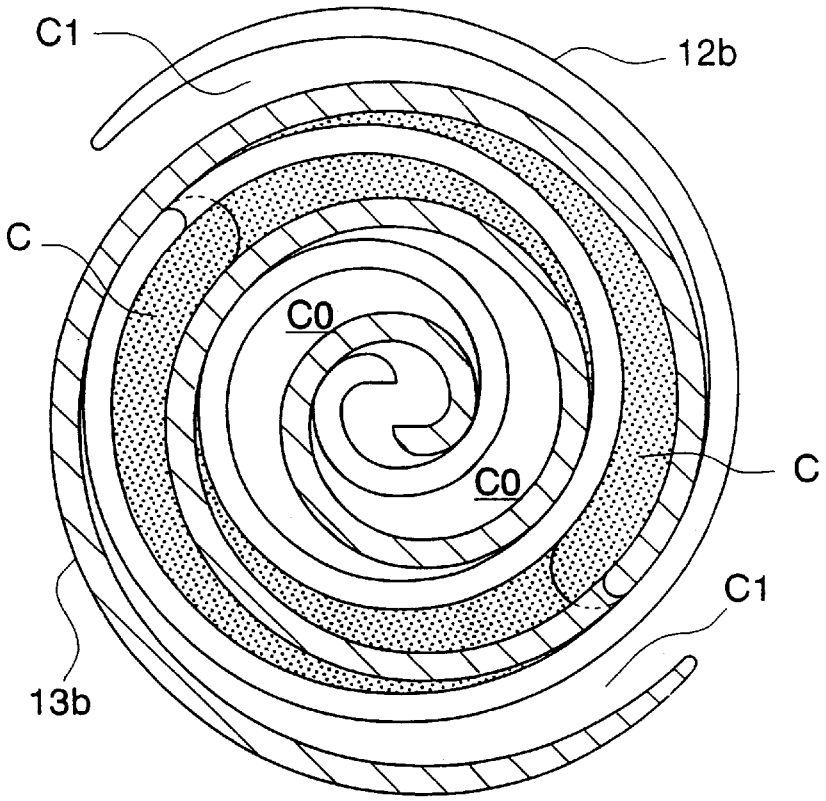
FIG. 7 is another diagram illustrating a process of compressing a fluid when driving the scroll compressor.

FIG. 7 shows the state when the orbiting scroll 13 has orbited by π/2 from the state shown in FIG. 6. In this process, the compression chamber C moves toward the center with its airtightness intact while compressing the fluid by the gradual reduction of its capacity; the compression chamber C0 preceding the compression chamber C also moves toward the center with its airtightness intact while continuing to compress the fluid by the gradual reduction of its capacity. The connecting edge 12*e* starts to slide against the connecting wall surface 13*h*, and the connecting edge 13*e* starts to slide against the connecting wall surface 12*h* in this process.

In the state shown in FIG. 7, a space C1 is formed between the inner side surface of the wall body 12*b*, which is near the outer peripheral end, and the outer side surface of the wall body 13*b*, positioned on the inner side of the inner side surface of the wall body 12*b*; this space C1 becomes a compression chamber later. Similarly, a space C1 is formed between the inner side surface of the wall body 13*b*, which is near the outer peripheral end, and the outer side surface of the wall body 12*b*, positioned on the inner side of the inner side surface of the wall body 13*b*; the space C1 also becomes a compression chamber later. A low-pressure fluid is fed into the space C1 from the low pressure chamber (LR).

Figure 8:
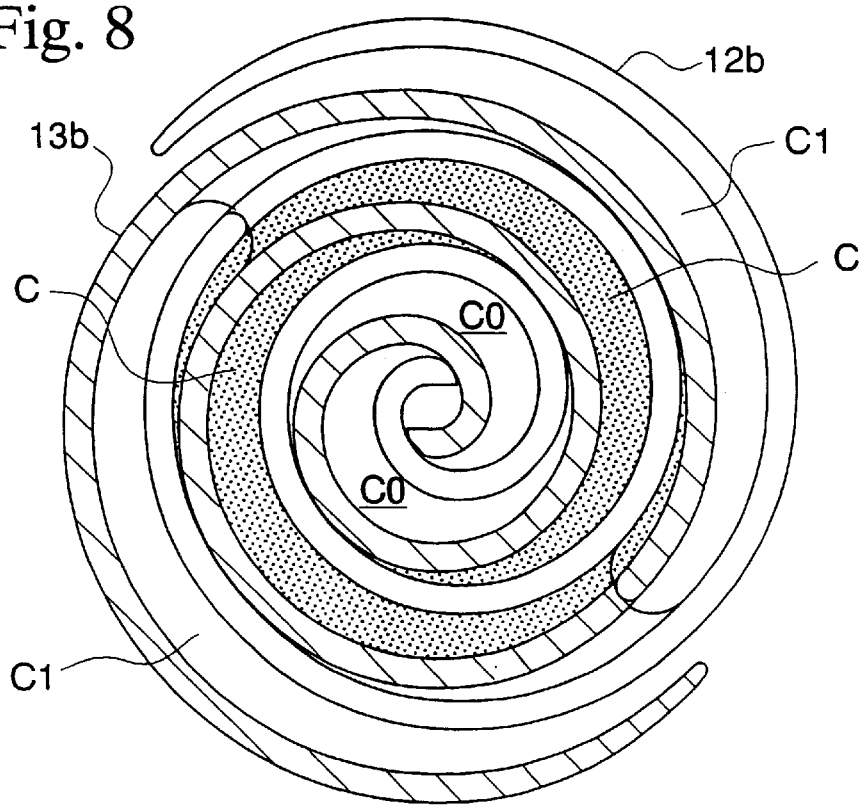
FIG. 8 is another diagram illustrating a process of compressing a fluid when driving the scroll compressor.
Figure 9A:
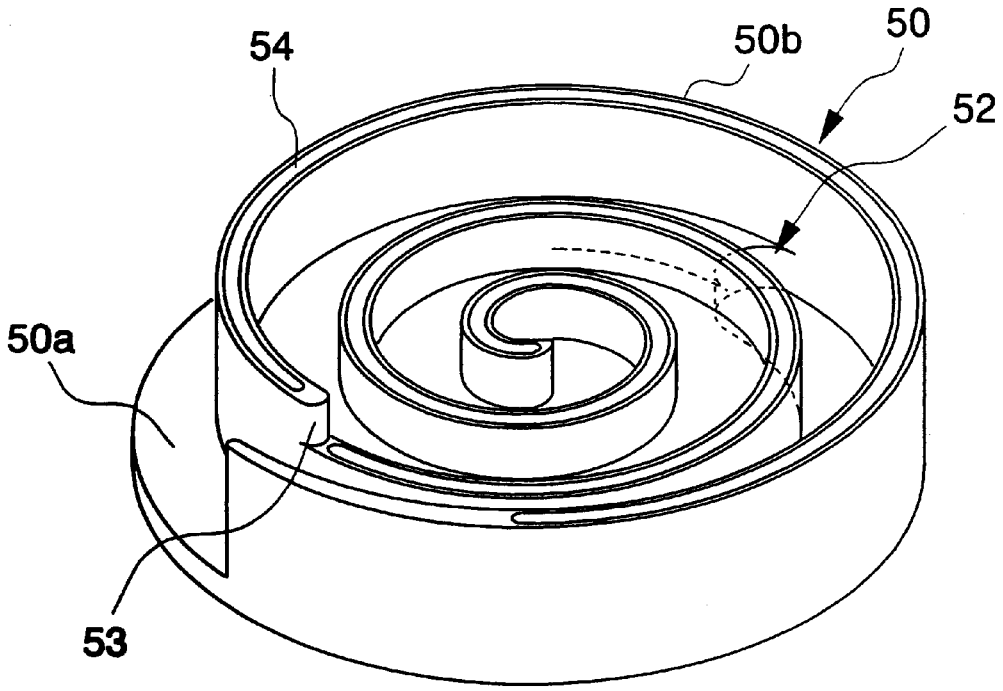
Fig. 9A PRIOR ART
FIG. 9A is a perspective view of a fixed scroll provided in a conventional scroll compressor.
Figure 9B:
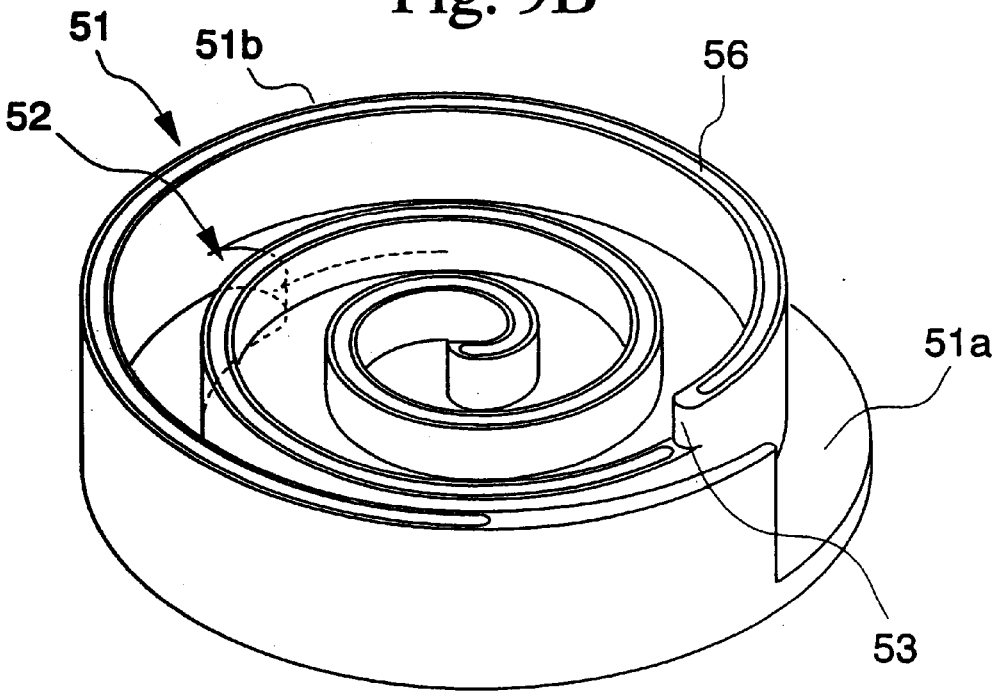
FIG. 9B is a perspective view of an orbiting scroll provided in a conventional scroll compressor.
Figure 10A:
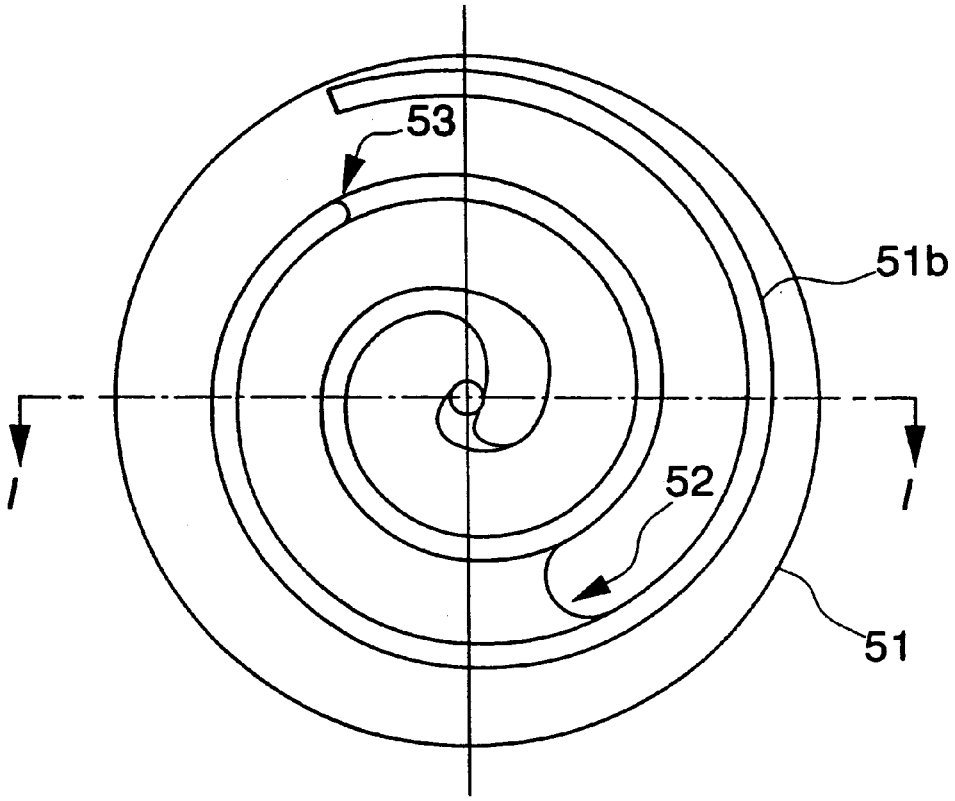
Fig. 10A PRIOR ART
FIG. 10A is a plan view of an orbiting scroll provided in a conventional scroll compressor.
Figure 10B:
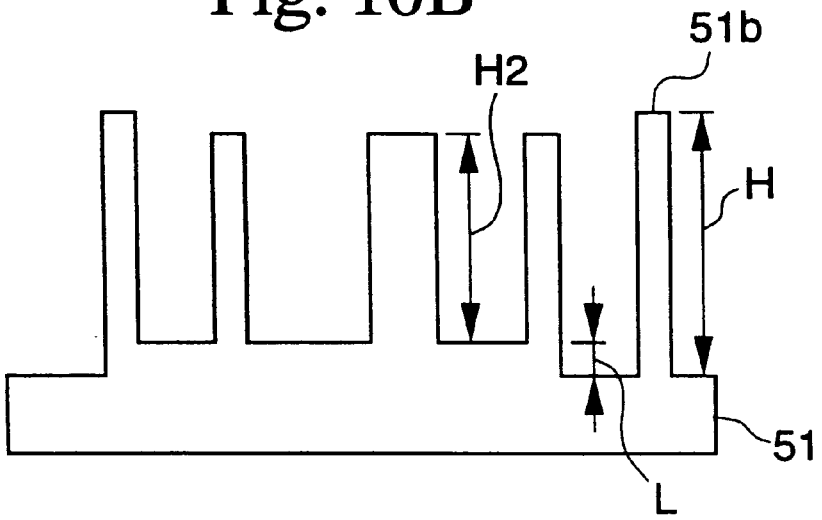
FIG. 10B is a side cross-sectional view of an orbiting scroll provided in a conventional scroll compressor.
Figure 11:
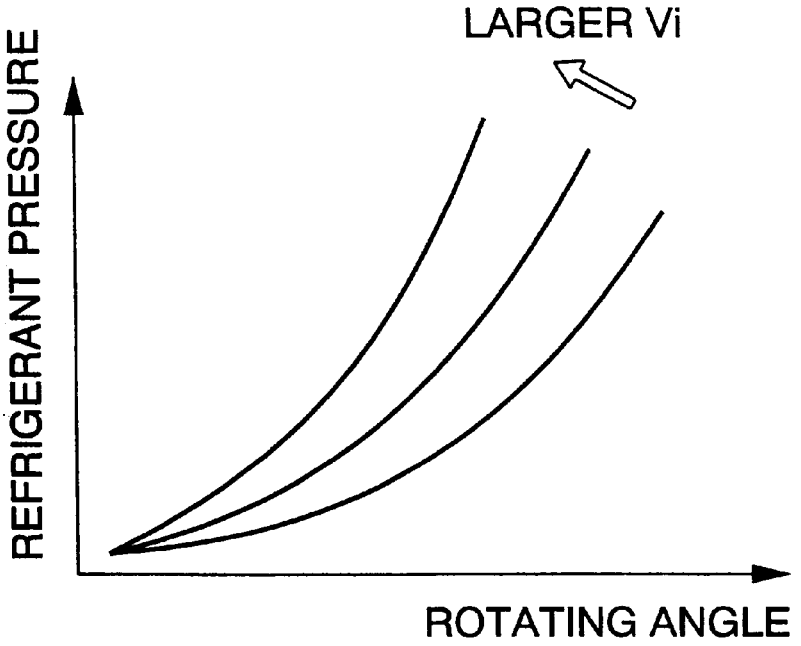
FIG. 11 is a graph showing the relationship between a rotation angle and pressure in compression chamber using Vi.

FIG. 8 shows the state when the orbiting scroll 13 has orbited by π/2 from the state shown in FIG. 7. In this process, the space C1 increases in size while moving toward the center of the scroll compressor mechanism; the compression chamber C preceding the space C1 also moves toward the center while compressing the fluid by the gradual reduction of its capacity.

FIG. 5 shows the state when the orbiting scroll 13 has orbited by π/2 from the state shown in FIG. 8. In this process, the space C1 further increases in size while moving toward the center of the scroll compressor mechanism; the compression chamber C preceding the space C1 also moves toward the center with its airtightness intact while compressing the fluid by the gradual reduction of its capacity. When the state has reached the state shown in FIG. 5, the compression chamber C0 shown in FIG. 5 becomes equal to the compression chamber C shown in FIG. 8, and the space C1 shown in FIG. 8 becomes equal to the compression chamber C shown in FIG. 5.

Consequently, while maintaining compression, the compression chamber reaches its minimum capacity and the fluid is discharged from the compression chamber C.

The fluid discharged is introduced into the high pressure chamber (HR). The fixed scroll 12 is pressed to the orbiting scroll 13 with high back pressure. The sealing member 15 is widened due to differential pressure generated by introducing the fluid having high pressure into the U-shaped part. The high pressure chamber (HR) and the low pressure chamber (LR) is sealed by compressing the surface of the sealing member 15 against the peripheral surfaces of the cylindrical flanges 16 and 17.

As described above, since the height H of the outer side wall body provided further out than the step portion is predetermined so that $L/H \leqq 0.2$, the loss generated by leakage of the fluid is prevented, and as a result, compression can be carried out with excellent compression efficiency.

Furthermore, in the above scroll compressor, volume variation of the compression chamber is not caused only by decrease of the cross-sectional area which is parallel to the orbiting face of the scroll, but variation is synergisticly caused by decrease of the width in the direction of the orbiting axis, of the compression chamber and decrease of the cross-sectional area.

A difference is provided between the lap length of each wall body 12*b* and 13*b* at the outer end side, which is further out than the step portion, and the lap length of each wall body 12*b* and 13*b* at the center side, which is further in than the step portion, and then the maximum capacity of the compression chamber C is increased and the minimum capacity of the compression chamber C is decreased. As a result, compression ratio of the scroll compressor is improved in comparison with the compression ratio of the conventional scroll compressor having the uniform lap length of the wall bodies, concentration of stress is avoided, so that a superior scroll compressor is obtained.

A back pressure scroll compressor is mentioned as an embodiment; however, the present invention is not limited the above embodiment, and any scroll compressor can be adopted as long as the scroll compressor has step portions in the scrolls. Furthermore, considering lap strength (stress of lap), H and L may be determined accordingly.

What is claimed is:

1. A scroll compressor comprising:

a fixed scroll which is fixed in position and has a spiral wall body provided on one side surface of an end plate;

an orbiting scroll which has a spiral wall body provided on one side surface of an end plate, being supported by engaging of the wall bodies so as to orbit and revolve around the fixed scroll without rotation;

a first step portion provided on the end plate of one of the fixed scroll and the orbiting scroll, being at a high level at a center side and at a low level at an outer end side along the spiral wall body on one side surface of the end plate; and a second step portion provided on a top edge of the wall body of the other of the fixed scroll and the orbiting scroll by dividing the top edge into plural parts, the second step portion being at a high level to at a low level from the outer end to the center in correspondence with the first step portion, wherein, when a length of the wall body is represented by H at the outer side from the first step portion and a step difference of the first step portion is represented by L in the one scroll, L/H is 0.2 or less.

* * * * *